US006059896A

United States Patent [19]

Ehara et al.

[11] Patent Number: 6,059,896

[45] Date of Patent: May 9, 2000

[54] COMPOSITION AND PROCESS FOR TREATING THE SURFACE OF ALUMINIFEROUS METALS

[75] Inventors: Ryoji Ehara, Kanagawa-Ken; Masahiro Motozawa, Kenagawa-Ken; Tomoyuki Aoki, Kanagawa-Ken, all of Japan

[73] Assignee: Henkel Corporation, Gulph Mills, Pa.

[21] Appl. No.: 09/000,347

[22] PCT Filed: Jul. 19, 1996

[86] PCT No.: PCT/US96/11537

§ 371 Date: Jan. 21, 1998

§ 102(e) Date: Jan. 21, 1998

[87] PCT Pub. No.: WO97/04145

PCT Pub. Date: Feb. 6, 1997

[30] Foreign Application Priority Data

Jul. 21, 1995 [JP] Japan ..... H7-185604

[51] Int. Cl.[7] ..... C23C 22/48

[52] U.S. Cl. ..... 148/247; 148/259; 148/260; 148/274; 148/275; 427/388.4

[58] Field of Search ..... 148/247, 253, 148/259, 260, 261, 274, 275; 427/372.2, 385.5, 388.4, 444

[56] References Cited

U.S. PATENT DOCUMENTS

| | | | |
|---|---|---|---|
| 2,438,877 | 3/1948 | Spruance, Jr. | 148/6.16 |
| 4,136,073 | 1/1979 | Muro et al. | 148/247 |
| 4,148,670 | 4/1979 | Kelly | 148/6.15 R |
| 4,457,790 | 7/1984 | Lindert et al. | 148/6.15 R |
| 4,714,752 | 12/1987 | Sokalski | 148/251 |
| 4,795,506 | 1/1989 | Sokalski | 148/6.14 R |
| 4,859,351 | 8/1989 | Awad | 252/32.5 |
| 4,963,596 | 10/1990 | Lindert et al. | 526/313 |
| 4,970,264 | 11/1990 | Lindert et al. | 525/328.8 |
| 5,039,770 | 8/1991 | Lindert et al. | 526/312 |
| 5,063,089 | 11/1991 | Lindert et al. | 427/354 |
| 5,064,500 | 11/1991 | Awad | 427/388.4 |
| 5,068,299 | 11/1991 | Lindert et al. | 526/313 |
| 5,116,912 | 5/1992 | Lindert et al. | 525/340 |
| 5,246,507 | 9/1993 | Kodama et al. | 148/250 |
| 5,266,410 | 11/1993 | Lindert et al. | 428/461 |
| 5,356,491 | 10/1994 | Aoki et al. | 148/253 |
| 5,370,909 | 12/1994 | Tanaka et al. | 427/386.4 |
| 5,427,632 | 6/1995 | Dolan | 148/260 |
| 5,728,234 | 3/1998 | Aoki et al. | 148/251 |

FOREIGN PATENT DOCUMENTS

| | | |
|---|---|---|
| 3900149 | 7/1989 | Germany . |
| 52-131937 | 11/1977 | Japan . |
| 57-039314 | 8/1982 | Japan . |
| 61-091369 | 5/1986 | Japan . |
| 1-085292 | 3/1989 | Japan . |
| 1-172406 | 7/1989 | Japan . |
| 1-177379 | 7/1989 | Japan . |
| 1-177380 | 7/1989 | Japan . |
| 2-000608 | 1/1990 | Japan . |
| 2-000609 | 1/1990 | Japan . |
| 4-066671 | 3/1992 | Japan . |
| 5-239434 | 9/1993 | Japan . |
| 90 12902 | 11/1990 | WIPO . |
| 91 19828 | 12/1991 | WIPO . |
| 95 04169 | 2/1995 | WIPO . |
| 95 28449 | 10/1995 | WIPO . |
| 95 28509 | 10/1995 | WIPO . |

*Primary Examiner*—John Sheehan
*Assistant Examiner*—Andrew L. Oltmans
*Attorney, Agent, or Firm*—Wayne C. Jaeschke; Norvell E. Wisdom, Jr.; Wayne C. Jaeschke, Jr.

[57] ABSTRACT

A surface of aluminiferous metal is brought into contact at 25 to 65° C. for 2 to 100 seconds with a surface treatment bath with a pH of 1.0 to 6.0 that contains phosphate ions, dissolved titanium and/or zirconium compounds, dissolved fluorine-containing anions, and a water soluble polymer in the following weight proportions: 1–100:1–50:1–200:1–200. This is followed by a water rinse and drying. The water soluble polymer has a chemical structure conforming to formula (I), in which each of $X^1$ and $X_2$ represents a hydrogen atom, a $C_1$ to $C_5$ alkyl group, or a $C_1$ to $C_5$ hydroxyalkyl group; each of $Y^1$ and $Y^2$ represents a hydrogen atom or a moiety "Z" that to formula (II) or (III), wherein each of $R^1$, $R^2$, $R^3$, $R^4$, and $R^5$ represents a $C_1$ to $C_{10}$ alkyl group or a $C_1$ to $C_{10}$ hydroxyalkyl group; the average value for the number of Z moieties substituted on each aromatic ring in the polymer molecules is from 0.2 to 1.0; n is an integer; and the average value of n for the total polymer is from 2 to 50.

(I)

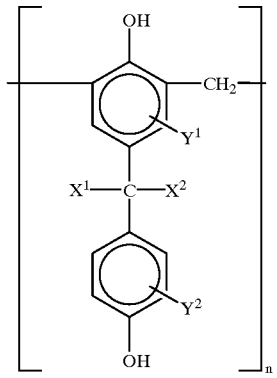

(II)

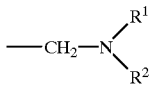

(III)

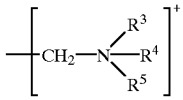

20 Claims, No Drawings

COMPOSITION AND PROCESS FOR TREATING THE SURFACE OF ALUMINIFEROUS METALS

TECHNICAL FIELD

The present invention relates to novel compositions and processes for surface treatment of metallic materials containing aluminum as their predominant constituent (e.g., alloys such as Al—Mn, Al—Mg, Al—Si, and the like). These compositions and processes confer outstanding corrosion resistance and adhesion to paint on the surface of aluminum-containing metal before painting this metallic material. The surface treatment of aluminum drawn and ironed (hereinafter usually abbreviated as "DI") cans is a field in which the present invention can be applied to particular benefit. Thus, it is possible by means of the present invention to confer on the surface of aluminum DI cans formed by drawing and ironing sheet aluminum alloy, before carrying out painting and printing, better corrosion resistance and adhesion to paint than with prior methods, and the superior low-friction characteristics needed for smooth conveyance of the cans, which hereinafter may be briefly denoted simply as "mobility".

BACKGROUND ART

Liquid compositions, which hereinafter are often called "baths" for brevity, even though they may be used by spraying or other methods of establishing contact than immersion, that are useful for treating the surface of aluminiferous metals, defined as aluminum and its alloys that contain at least 50% by weight of aluminum, may be broadly classified into chromate-type treatment baths and non-chromate-type treatment baths. The chromate-type surface treatment baths typically are divided into chromic acid chromate conversion treatment baths and phosphoric acid chromate conversion treatment baths. Chromic acid chromate conversion treatment baths were first used in about 1950 and are still in wide use at present for the surface treatment of, for example, heat exchanger fins and the like. Chromic acid chromate conversion treatment baths contain chromic acid (i.e., $CrO_3$) and hydrofluoric acid (HF) as their essential components and may also contain a conversion accelerator. These baths form a coating that contains small amounts of hexavalent chromium.

The phosphoric acid chromate conversion treatment bath was invented in 1945 (see U.S. Pat. No. 2,438,877). This conversion treatment bath contains chromic acid ($CrO_3$), phosphoric acid ($H_3PO_4$), and hydrofluoric acid (HF) as its essential components. The main component in the coating produced by this bath is hydrated chromium phosphate ($CrPO_4.4H_2O$). Since this conversion coating does not contain hexavalent chromium, this bath is still in wide use at present as, for example, a paint undercoat treatment for the lid and body of beverage cans. However, these chromate type surface treatment solutions are environmentally problematic because the bath, unlike the coating formed with it, contains hexavalent chromium; therefore, the use of treatment solutions which do not contain hexavalent chromium is desirable.

The treatment bath taught in Japanese Patent Application Laid Open [Kokai or Unexamined] Number Sho 52-131937 [131,937/1977] is typical of the non-chromate-type conversion treatment baths. This treatment bath is an acidic (pH= approximately 1.0 to 4.0) waterbome coating solution that contains phosphate, fluoride, and zirconium or titanium or their compounds. Treatment of aluminiferous metal surfaces with this non-chromate-type conversion treatment bath produces thereon a conversion film whose main component is zirconium and/or titanium oxide. The absence of hexavalent chromium is one advantage associated with the non-chromate-type conversion treatment baths; however, the conversion coatings produced by them in many instances exhibit a corrosion resistance and paint adherence that is inferior to those of the coatings generated by chromate-type conversion treatment baths.

The use of water-soluble resins in surface treatment baths and methods intended to provide aluminiferous metals with corrosion resistance and paint adherence is described, for example, in Japanese Patent Application Laid Open [Kokai or Unexamined] Numbers Sho 61-91369 [91,369/1986] and Hei 1-172406 [172,406/1989], Hei 1-177379 [177,379/1989], Hei 1-177,380 [177,380/1989], Hei 2-608 [608/1990], and Hei 2609 [609/1990]. In these examples of the prior art surface treatment baths and methods, the metal surface is treated with a solution containing a derivative of a polyhydric phenol compound. However, the formation of an acceptably stable resin-containing coating on the aluminiferous metal surface sometimes is highly problematic with these prior art methods, and they do not always provide an acceptable performance (corrosion resistance). The invention described in Japanese Patent Application Laid Open [Kokai or Unexamined] Number Hei 4-66671 [66,671/1992] constitutes an improvement to treatment methods that use polyhydric phenol derivatives, but even in this case the problem of an unsatisfactory adherence sometimes arises.

The surface of DI aluminum cans is at present treated mainly with the above-described phosphoric acid chromate surface treatment baths and zirconium-containing non-chromate surface treatment baths. The outside bottom surface of DI aluminum cans is generally not painted, but is subjected to high-temperature sterilization by immersion in boiling tap water. If the corrosion resistance of the aluminum is poor, it will become oxidized and darkened by components in the tap water. This phenomenon is generally known as "blackening".

Some aluminum DI cans are sterilized with high-pressure steam; however, a known problem of this process is whitening of the appearance by the growth of aluminum oxide crystals due to steam. In order to avoid this problem, the outer surface of the bottoms of aluminum DI cans sterilized with high-pressure steam has to be protected by painting. Ideally, the coating produced by surface treatment by itself, even when unpainted, would have to exhibit a high corrosion resistance.

Turning to another issue, a high friction coefficient for the can's exterior surface will cause the can surface to have a poor mobility during the conveyor transport that occurs in the can fabrication and finishing processes. This will cause the can to tip over, which will obstruct the transport process. Can transportability is a particular concern with regard to transport to the printer. Thus, there is demand in the can fabrication industry for a lowering of the static friction coefficient of the can's exterior surface, which, however, must be achieved without adversely affecting the adherence of the paint or ink which will be coated on the can. The invention disclosed in Japanese Patent Application Laid Open [Kokai or Unexamined] Number Sho 64-85292 [85,292/1989] is an example of a method directed to improving this mobility. This invention relates to a surface treatment agent for metal cans, wherein said surface treatment agent contains water-soluble organic substance selected from phosphate esters, alcohols, monovalent and polyvalent fatty acids, fatty acid derivatives, and mixtures of the preceding.

While this method does serve to increase the mobility of aluminum cans, it affords no improvement in corrosion resistance or paint adherence. The invention described in Japanese Patent Application Laid Open [Kokai or Unexamined] Number Hei 5-239434 [239,434/1993] is another method directed to improving the mobility of aluminum cans. This invention is characterized by the use of phosphate esters. This method does yield an improved mobility, but again it affords no improvement in corrosion resistance or paint adherence.

DISCLOSURE OF THE INVENTION

Problems to Be Solved by the Invention

The present invention is directed to solving the problems described above for the prior art. In specific terms, the present invention introduces a composition is and method for treating the surface of aluminiferous metal which are able to provide the surface of aluminiferous metal with an excellent corrosion resistance and paint adherence. When applied in particular to DI aluminum cans, said composition and method impart thereto an excellent mobility in combination with an excellent corrosion resistance and paint adherence.

Summary of the Invention

It has been found that the problems described above for the prior art can be solved when a specific type of surface treatment bath, which contains a combination of phosphate ions, at least one zirconium compound or titanium compound, a fluoride, and a water-soluble resin having a specified structure, combined in specified proportions, is brought into contact with the surface of an aluminum-containing metallic material, and the thus treated surface of the metallic material is then rinsed with water and hot dried. It was found that the application of this surface treatment bath to the surface of aluminiferous metal will form thereon a very corrosion-resistant and highly paint-adherent resin-containing coating. It was also found that application of said bath to DI aluminum cans forms thereon a resin-containing coating that exhibits an improved mobility in addition to an excellent corrosion resistance and paint adherence. The invention was achieved based on these discoveries.

DETAILS OF THE INVENTION, INCLUDING PREFERRED EMBODIMENTS THEREOF

A composition according to the present invention characteristically comprises, preferably consists essentially of, or more preferably consists of, water and, in parts by weight:

(A) from 1 to 100 parts of dissolved phosphate ions;

(B) an amount of material selected from the group consisting of dissolved zirconium and/or titanium containing compounds that is stoichiometrically equivalent to from 1 to 50 parts of zirconium and/or titanium atoms;

(C) an amount of material selected from the group consisting of dissolved fluorine containing anions that is stoichiometrically equivalent to from 1 to 100 parts of fluorine atoms; and (D) from 1 to 200 parts of dissolved polymer conforming to the following general formula (I):

(I)

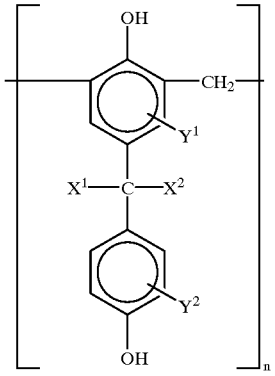

in which each of $X^1$ and $X^2$ independently of each other and independently from one unit of the polymer, said unit being defined as a moiety conforming to a modification of formula (I) above with the brackets and the subscript n omitted, to another unit of the polymer represents a hydrogen atom, a $C_1$ to $C_5$ alkyl group, or a $C_1$ to $C_5$ hydroxyalkyl group; each of $Y^1$ and $Y^2$ independently of one another and independently for each unit of the polymer represents a hydrogen atom or a moiety "Z" which conforms to one of the following formulas (II) and (III):

(II)

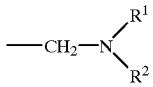

(III)

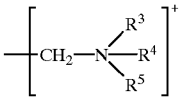

wherein each of $R^1$, $R^2$, $R^3$, $R^4$, and $R^5$ in formulas (II) and (III) independently represents a $C_1$ to $C_{10}$ alkyl group or a $C_1$ to $C_{10}$ hydroxyalkyl group; the moiety Z bonded to any single aromatic ring in the polymer molecule may be identical to or may differ from the moiety Z bonded to any other aromatic ring in the polymer molecule; the average value for the number of Z moieties substituted on each aromatic ring in the polymer molecule is from 0.2 to 1.0; n is a positive integer; and the average value of n over all of component (D), which may be referred to hereinafter as "the average degree of polymerization", is from 2 to 50. This average value for the number of Z moieties substituted on each aromatic ring in the polymer molecules of total component (D) may be hereinafter referred to as the average value for Z moiety substitution. Preferably, in a single unit of the polymer, $X^1$ is the same as $X^2$ and, independently, $Y^1$ is the same as $Y^2$.

Surface treatment compositions of the present invention optionally also may contain from 1 to 100 parts by weight of an oxidizing agent, which preferably comprises, more preferably consists essentially of, or still more preferably consists of at least one of the group consisting of hydrogen peroxide and organic peroxy compounds.

Compositions according to the invention as described above may be either working compositions, suitable for directly treating aluminiferous metal substrates, or they may be concentrate compositions, which are useful for preparing working compositions, usually by dilution of the concentrate compositions with water, and optionally, adjustment of the pH of the resulting working composition. In a working composition, independently for each component noted, the concentration of dissolved phosphate ions preferably is from 0.01 to 1.0 gram per liter (hereinafter usually abbreviated as "g/L"), the concentration of component (B) preferably corresponds to a stoichiometric amount of from 0.01 to 0.5 g/L in total of atomic zirconium and atomic titanium, the concentration of component (C) preferably corresponds to a stoichiometric amount of from 0.01 to 2.0 g/L of atomic fluorine, the concentration of component (D) preferably is from 0.01 to 2.0 g/L, and the pH preferably is from 1.0 to 5.0. If any oxidizing agent is present in a working composition, its concentration preferably is from 0.01 to 1.0 g/L. The pH of a concentrate composition preferably is from 0.8 to 5.0.

A method according to the present invention for treating the surface of aluminiferous metal characteristically comprises contacting the surface of aluminiferous metal with a surface treatment bath containing the above-described components according to the present invention, then rinsing the treated surface with water, and subsequently drying the surface.

Phosphoric acid ($H_3PO_4$) sodium phosphate ($Na_3PO_4$), ammonium phosphate $\{(NH_4)_3PO_4\}$ and the like can be used as the source of the phosphate ions in the surface treatment composition according to the present invention, and the full stoichiometric equivalent as $PO_4^{-3}$ ions of any such dissolved sources is to be considered part of the phosphate ions content, irrespective of the actual degree of ionization that prevails in the composition. The phosphate ions content in the above-described formulation ranges from 1 to 100 parts by weight (here-inafter often abbreviated "pbw"), while a more preferred range is from 2 to 40 pbw, based on 1–200 pbw of water soluble polymer component (D). Reaction between the surface treatment bath and the metal surface will be normally insufficient and film formation often will be inadequate when the phosphate ions content in the above-described formulation is less than 1 pbw. While a good-quality film is formed with more than 100 pbw of phosphate ions, the high cost of the resulting treatment bath makes such levels economically undesirable, because no additional benefit is achieved.

Oxides such as zirconium oxide and titanium oxide, hydroxides such as zirconium hydroxide and titanium hydroxide, fluorides such as zirconium fluoride and titanium fluoride, and nitrates such as zirconium nitrate and titanium nitrate can be used as the source of the zirconium compound (s) and/or titanium compound(s) contained in a surface treatment composition of the present invention, but water-soluble compounds, and/or compounds that react to form water-soluble compounds, other than the above can also be used. The concentration of these compounds preferably corresponds to a stoichiometric equivalent of zirconium and/or titanium metal in the range from 1 to 50 parts by weight, or more preferably from 2 to 8 parts by weight, based on 1 to 100 parts by weight of phosphate ions. At a ratio of less than 1 part by weight, the surface treatment often does not form an adequate coating film. Use of a ratio of these metals exceeding 50 parts by weight is economically wasteful, because although a satisfactory coating film can be formed, there is no additional benefit and the cost is higher.

Acids such as hydrofluoric acid (i.e., HF), fluozirconic acid (i.e., $H_2ZrF_6$) and fluotitanic acid (i.e., $H_2TiF_6$), and the like, and salts thereof (e.g. ammonium salts, sodium salts, and the like) can be advantageously employed as a source of fluoride in a surface treatment composition of the present invention, and can supply the zirconium and/or titanium required as well as the fluoride, but the invention is not restricted to using these compounds above. The ratio by weight of fluorine atoms in component (C) is preferably in the range from 1 to 200 parts, or more preferably from 3 to 60 parts, to 1 to 100 parts of phosphate ions. With a ratio of less than 1 part by weight, an adequate coating film is usually not formed because of the poor reactivity of the resulting surface treatment solution. A ratio of more than 200 parts by weight is undesirable, because the amount of etching in the surface of the aluminumcontaining metallic material becomes excessive and the appearance of the coating film is adversely affected. The most preferable fluoride content depends on the aluminum concentration eluting from the material, and hence will vary with this aluminum concentration. This is because the fluoride is needed in order for the eluted aluminum to remain present stably in the treatment solution as aluminum fluoride. For example, the quantity of fluorine needed to stabilize a treatment solution with an aluminum concentration of 1.0 g/L is about 2 g/L.

Hydrogen peroxide, organic peroxy compounds, and acids such as nitrous acid, tungstic acid, molybdic acid and peroxy acids (e.g. peroxyphosphoric acid), etc., and salts thereof can be used as the oxidant contained in a surface treatment composition of the present invention. However, when effluent treatment after use of the surface treatment solution containing this composition is considered, the use of hydrogen peroxide as an oxidizing agent is most preferred, except that, when the surface treatment solution contains titanium, hydrogen peroxide may form a complex compound with titanium and hinder the formation of a titanium containing coating film; in this case it is most preferable to use an organic peroxy compound. Oxidizing agents have the effect of accelerating the velocity of the reaction which produces a zirconium coating film or titanium coating film on the aluminum or aluminum alloy. Oxidizing agent is preferably present in amounts such as to give a ratio by weight of from 1 to 100 parts, or more preferably from 2 to 50 parts, to 1 to 100 parts by weight of phosphate ions. With a content of oxidizing agent of less than 1 part by weight the benefits in terms of accelerating the reaction in surface treatment with an agent for surface treatment containing this is usually inadequate. And although there is no technical problem with using more than 100 parts by weight, this is economically wasteful because there is no extra benefit.

Polymer according to formula (I) with an average n value less than 2 yields only an insufficient improvement in the corrosion resistance of the resulting surface coating. The stability of the corresponding surface treatment composition and surface treatment bath is sometimes inadequate and practical problems often ensue in the case of polymer (I) with an average n value greater than 50.

The presence of 6 or more carbons in the alkyl and hydroxyalkyl groups represented by $X^1$ and $X^2$ in formula (I) causes the resulting polymer molecule to be bulky and produces steric hindrance. This usually interferes with the formation of the fine, dense coatings that exhibit excellent corrosion resistance.

Polymer (I) contains the Z moiety as a substituent, and the average value for Z moiety substitution for each aromatic ring in the polymer molecule preferably ranges from 0.2 to 1.0. As an example, in a polymer with n=10 that has 20 aromatic rings, if only 10 of these 20 aromatic rings are substituted by one Z moiety each, the average value for Z moiety substitution for this polymer is then calculated as follows: (1×10)/20=0.5.

The polymer usually is insufficiently water soluble when the average value for Z moiety substitution is below 0.2; this results in an insufficiently stable surface treatment concentrate and/or surface treatment bath. When, on the other hand, the average value substitution of an aromatic ring is by 2 or more moieties Z, the resulting polymer becomes so soluble in water that formation of an adequately protective surface film is impeded.

The alkyl and hydroxyalkyl moieties encompassed by $R^1$, $R^2$, $R^3$, $R^4$, and $R^5$ in formulas (II) and (III) should contain from 1 to 10 carbon atoms each. The polymer molecule becomes bulky when this number of carbons exceeds 10; this results in a coarse coating and thereby in an insufficient improvement in the corrosion resistance.

The content of water-soluble polymer (I) in the above-described formulation for the surface treatment composition according to the present invention ranges from 1 to 200 pbw, when the composition also contains from 1 to 100 pbw of phosphate ions. The formation of a coating on the metal surface by the corresponding surface treatment bath often becomes quite problematic when the content of the water-soluble polymer in the above-described formulation is below 1 pbw. Values above 200 pbw are economically undesirable due to the increased cost, with no added benefit.

When the pH of a working composition is less than 1.0, the etching effect on the surface of aluminum-containing metallic material is usually excessive, and as a consequence it may become difficult to form a coating film. On the other hand, if the pH exceeds 5.0, the resin is prone to precipitate, and as a consequence the useful life of the treatment solution is shortened and it becomes difficult to form a coating film. The pH is most preferably kept within the range from 2.0 to 4.0. The pH of the surface treatment solution in the method of the present invention is most preferably adjusted using nitric acid and ammonium hydroxide.

If the surface treatment solution is contaminated with aluminum ions dissolved from the material, the resin and the metal may form a complex and produce a precipitate. The addition to the treatment solution of an aluminum sequestering agent is efficacious in such instances. It is also possible to add hydrofluoric acid and sequester aluminum ions as an aluminum-fluorine complex; however, the addition of excess hydrofluoric acid must be avoided, because it hinders the deposition of zirconium and titanium. Ethylene diamine tetra-acetic acid, 1,2-cyclohexanediamine tetra-acetic acid, triethanolamine, gluconic acid, heptogluconic acid, oxalic acid, tartaric acid, malic acid, an organic phosphonic acid, or the like, can also be efficaciously added as aluminum sequestering agents.

Problems with the coating can occur due to foaming of the surface treatment bath when a spray treatment is used. The generation of foam and the intensity of foaming strongly depend on the type of spray equipment and the spraying conditions, and a defoamer is preferably added to the surface treatment bath when a foaming problem cannot be satisfactorily resolved by changes to the spray equipment and/or conditions. Such factors as the type and dispensing level of the defoamer are not critical, provided that they do not impair the paint adherence of the resulting coating.

A method or process according to the present invention in its simplest form is implemented by bringing an aluminiferous surface into contact with a working composition according to the invention as described above for a sufficient time to form a coating on the aluminiferous substrate, then rinsing the coated substrate with water, and drying the rinsed coated surface. The temperature and time during the contacting between a working composition according to the invention and the substrate are not narrowly restricted, but a time of 2 to 100, more preferably 3 to 50, or still more preferably 5 to 20, seconds and, independently, a temperature of 25 to 60° C. are generally preferred. With a contact time of less than 2 seconds, the reaction of the treatment solution and the surface of the metallic material is usually inadequate, so that a coating film with outstanding corrosion resistance cannot be obtained. When the time exceeds 100 seconds, there is usually no substantial improvement in performance of the resulting coating film.

Contact between the aforementioned surface treatment solution and the surface of the aforementioned metallic material may be carried out by immersing the aforementioned metallic material in the aforementioned surface treatment solution, or by spraying the aforementioned surface treatment solution onto the surface of the aforementioned metallic material. It has been found that, when the treatment solution is sprayed, the formation of the coating film may be inadequate if the treatment solution is sprayed continuously. Consequently, intermittent spraying twice or more, with an interspraying interval of from 1 to 5 seconds between is preferred. Inasmuch as no rinsing or other method of forcibly removing the treatment solution according to the invention is normarly undertaken during these short interspraying intervals, some contact between the treatment solution and the substrate being treated is believed to persist, and the total treatment contact time is defined to include the interspraying intervals as well as the periods of time during which contact is forced by spraying.

The three steps noted above for a minimal process according to the invention may be, and usually preferably are, supplemented by other steps that are known per se. For example, careful cleaning of the substrate to be treated is almost always preferred. Also, known phosphoric acid treatment solutions for aluminum treatment can be utilized prior to a treatment with a working composition according to the invention. Concrete examples of such treatments include the treatment solutions taught in Japanese Examined Patent 52-131937 and Japanese Unexamined Patent 57-39314. When these treatment solutions do not include any component which detracts from the benefits of the present invention the treatment of the present invention can be performed immediately after the other treatment without intervening rinsing with water. When the phosphoric acid treatment solution does include an ingredient which detracts from the benefits of the present invention, the surface treatment of the present invention is preferably performed after washing with water following the other phosphoric acid treatment.

Non-exclusive examples of suitable complete process sequences according to the invention for aluminum cans are:

Surface Treatment Process 1

(1) Surface washing of DI cans: degreasing (can be an acid system, alkaline system or solvent system)

Treatment temperature: 40–80° C.

Method of treatment: spray

Duration of treatment: 25–60 seconds (2) Rinsing with water (3) Surface treatment with a surface treatment solution of the present invention Treatment temperature: 25–60° C.

Method of treatment: spray

Duration of treatment: 15–100 seconds (4) Rinsing with water
(5) Rinsing with deionized water
(6) Drying Surface Coating Process 2

(1) Surface washing of DI cans: degreasing (can be an acid system, alkaline system or solvent system)
Treatment temperature: 40–80° C.
Method of treatment: spray
Duration of treatment: 25–60 seconds
(2) Rinsing with water
(3) Phosphate treatment previously known, as exemplifed above
Treatment temperature: 25–60° C.
Method of treatment: spray
Duration of treatment: 8–30 seconds
(4) Surface treatment with a surface treatment solution of the present invention
Treatment temperature: 25–60° C.
Method of treatment: spray
Duration of treatment: 2–30 seconds
(5) Rinsing with water
(6) Rinsing with deionized water
(7) Drying Surface Treatment Process 3

(1) Surface washing of DI cans: degreasing (can be an acid system, alkaline system or solvent system)
Treatment temperature: 40–80° C.
Method of treatment: spray
Duration of treatment: 25–60 seconds
(2) Rinsing with water
(3) Phosphate treatment previously known, as exemplifed above
Treatment temperature: 30–50° C.
Method of treatment: spray
Duration of treatment: 8–30 seconds
(4) Rinsing with water
(5) Surface treatment with a surface treatment solution of the present invention
Treatment temperature: 25–60° C.
Method of treatment: spray
Duration of treatment: 2–30 seconds
(6) Rinsing with water
(7) Rinsing with deionized water
(8) Drying Aluminiferous metal substrates that may be subjected to the method according to the present invention comprise, for example, the sheet, bar, tube, wire, and like shapes, of aluminum and its alloys, e.g., aluminum-manganese alloys, aluminum-magnesium alloys, aluminum-silicon alloys, and the like. There are absolutely no limitations on the dimensions or shape of the aluminiferous metal.

The polymer composition according to the present invention may contain a preservative or antimold agent. These function to inhibit putrefaction or mold growth when the surface treatment bath is used or stored at low temperatures. Hydrogen peroxide is a specific example in this regard.

The quantity of surface coating film formed by the present invention on the surface of a metallic material containing aluminum is preferably from 6 to 20 milligrams per square meter (hereinafter usually abbreviated as "$mg/m^2$) as a mass of atomic zirconium and/or atomic titanium. If this is less than 6 $mg/m^2$ the corrosion resistance of the coating film obtained becomes inadequate, and when it exceeds 20 $mg/m^2$ the adhesion of the coating film to paint becomes inadequate.

The invention is illustrated in greater detail below through working examples, and its benefits may be further appreciated by contrast with the comparison examples. The individual surface treatment bath components and surface treatment methods are respectively described in the working and comparative examples.

EXAMPLES

1. Test Materials

Aluminum DI cans made by DI processing of sheet aluminum were submitted to surface treatment after cleaning using a hot aqueous solution of an acidic degreasing preparation (named PALKLIN® 500, from Nihon Parkerizing Co.).

2. Methods of Evaluation 2.1 Corrosion Resistance

The corrosion resistance of the aluminum DI cans was evaluated on the basis of resistance to darkening in boiling water and resistance to whitening when exposed to hot steam as described below.

2.1.1 Resistance to Darkening

The surface-treated aluminum DI cans were immersed for 30 minutes in boiling tap water, and the degree of discoloration (darkening) caused thereby was assessed visually. The results of this test are reported on the following scale:

+: no blackening
x: partial blackening
xx: blackening over entire surface.

2.1.2 Resistance to Whitening

Surface treated aluminum DI cans were placed for 30 minutes in a high-pressure steam autoclave at 121° C., after which whitening of the surface was visually evaluated. The results of this test are reported on the following scale:

+: no whitening
x: partial whitening
xx: whitening over entire surface.

2.2 Mobility

Mobility was evaluated based on the following test using a sliding tester. Three of the surface-treated aluminum DI sample cans were placed on the horizontally positioned tiltable plate of the sliding tester. Two of the cans, were loaded with their bottom ends facing to the front. The remaining single can, was loaded with its open end facing to the front.

The tiltable plate was then tilted at a constant rate of 3° of angle per second by the action of the motor. The coefficient of static friction was calculated from the angle of inclination, determined from the time required until at least one can fell off. The results of this test are reported on the following scale:

+: coefficient of friction less than 1.0
x: coefficient of friction greater than 1.0 but less than 1.5
xx: coefficient of friction 1.5 or greater.

2.3 Test of Adhesion to Paint

Adhesion to paint was evaluated by painting an epoxyurea can paint onto the surface of surface-treated aluminum cans to a paint film thickness of 5 to 7 micrometers (hereinafter usually abbreviated as "$\mu$m"), baking at 215° C. for 4 minutes, then cross-hatch cutting the surface to be evaluated with a knife so as to produce 100 squares each 2 millimeters on each edge, and performing a cellophane tape peel test to determine primary adhesion. After this, the sample was immersed for 60 minutes in a container of boiling aqueous liquid with the composition given below, and the cellophane tape peel test was performed again to determine secondary adhesion. Adhesion was reported as either the presence or absence of peeling.

Aqueous Liquid Composition for Secondary Adhesion Test

Sodium chloride 5 g/L

Citric acid 5 g/L

Deionized water for the balance of the composition.

Example 1

Cleaned DI aluminum cans were spray treated for 20 seconds with ALODINE® 404 zirconium phosphate surface treatment solution for aluminum DI cans (commercially supplied by Nihon Parkerizing) warmed to 35° C., and then spray treated for 10 seconds with Surface Treatment Solution 1 of the composition below warmed to 35° C. They were then rinsed with tap water, sprayed for 10 seconds with deionized water having a resistance of ≧3,000,000 ohm·cm, and then dried for 2 minutes in a hot air drier at 200° C. These aluminum DI cans were then evaluated for corrosion resistance and adhesion by the aforementioned methods.

Composition of Surface Treatment Solution 1 (ppm=parts per million of the total composition by weight)

| | | |
|---|---|---|
| 75% Phosphoric acid (i.e., $H_3PO_4$) | 138 ppm | ($PO_4$: 100 ppm) |
| 20% Fluozirconic acid (i.e., $H_2ZrF_6$) | 1137 ppm | (Zr: 100 ppm) |
| 20% Hydrofluoric acid (i.e., HF) | 235 ppm | ($F^1$: 170 ppm) |
| Water-soluble resin (solids basis) | 500 ppm | |

[1]In this and all subsequent treatment compositions according to the invention shown, the value is for the total amount of fluoride from all sources specified. In this instance, both the fluozirconic acid and the hydrofluoric acid used supply fluoride to the composition.

The water-soluble resin conformed to Formula (1) above when n=5, $X^1=X^2$=hydrogen atoms, and $Y^1=Y^2=CH_2N(CH_3)_2$.

pH 3.0, adjusted using nitric acid and aqueous ammonia.

Example 2

Cleaned aluminum DI cans were initially spray treated in the same manner as described in Example 1 prior to treatment with Surface Treatment Solution 1, then spray treated for 10 seconds with Surface Treatment Solution 2 of the composition below warmed to ≧35° C. The cans were then rinsed with tap water, washed with deionized water and hot-air dried as in Example 1. These aluminum DI cans were then evaluated for corrosion resistance and adhesion by the aforementioned methods.

Composition of Surface Treatment Solution 2

| | | |
|---|---|---|
| 75% Phosphoric acid (i.e. $H_3PO_4$) | 138 ppm | ($PO_4$: 100 ppm) |
| 20% Fluozirconic acid (i.e., $H_2ZrF_6$) | 455 ppm | (Zr: 40 ppm) |
| 20% Hydrofluoric acid (i.e., HF) | 210 ppm | (F: 90 ppm) |
| Water-soluble resin | 750 ppm | |

The water-soluble resin was the same as that used in Surface Treatment Solution 1.

pH 3.0, adjusted using nitric acid and aqueous ammonia.

Example 3

Cleaned aluminum DI cans were spray treated in the same manner as described in Example 1 prior to treatment with Surface Treatment Solution 1, then spray treated for 5 seconds with Surface Treatment Solution 3 of the composition below warmed to 45° C. They were then rinsed with tap water, washed with deionized water and hot-air dried as in Example 1. These aluminum DI cans were then evaluated for corrosion resistance and adhesion by the aforementioned methods.

Composition of Surface Treatment Solution 3

| | | |
|---|---|---|
| 75% Phosphoric acid ($H_3PO_4$) | 413 ppm | ($PO_4$: 300 ppm) |
| 20% Fluotitanic acid ($H_2TiF_6$) | 683 ppm | (Ti: 40 ppm) |
| 20% Hydrofluoric acid (HF) | 262 ppm | (F: 100 ppm) |
| Water-soluble resin | 750 ppm | |

The water-soluble resin was the same as that used in Surface Treatment Solution 1.

pH 3.0, adjusted using nitric acid and aqueous ammonia

Example 4

Cleaned aluminum DI cans were spray treated in the same manner as described in Example 1 prior to treatment with Surface Treatment Solution 1, then treated by immersion for 30 seconds in Surface Treatment Solution 4 of the composition below warmed to 50° C. They were then rinsed with tap water, washed with deionized water and hot-air dried as in Example 1. These aluminum DI cans were then evaluated for corrosion resistance and adhesion by the aforementioned methods.

Composition of Surface Treatment Solution 4

| | | |
|---|---|---|
| 75% Phosphoric acid ($H_3PO_4$) | 138 ppm | ($PO_4$: 100 ppm) |
| 20% Fluozirconic acid ($H_2ZrF_6$) | 1137 ppm | (Zr: 40 ppm) |
| 20% Hydrofluoric acid (HF) | 235 ppm | (F: 170 ppm) |
| Water-soluble resin | 500 ppm | |

The water-soluble resin was the same as that used in Surface Treatment Solution 1.

pH 2.8, adjusted using nitric acid and aqueous ammonia

Example 5

Cleaned aluminum DI cans were spray treated in the same manner as described in Example 1 prior to treatment with Surface Treatment Solution 1, then spray treated for 8 seconds in Surface Treatment Solution 5 of the composition below warmed to 35° C. They were then rinsed with tap water, washed with deionized water and hot-air dried as in Example 1. These aluminum DI cans were then evaluated for corrosion resistance and adhesion by the aforementioned methods.

Composition of Surface Treatment Solution 5

| | | |
|---|---|---|
| 75% Phosphoric acid ($H_3PO_4$) | 138 ppm | ($PO_4$: 100 ppm) |
| 20% Fluozirconic acid ($H_2ZrF_6$) | 1137 ppm | (Zr: 100 ppm) |
| 20% Hydrofluoric acid (HF) | 235 ppm | (F: 170 ppm) |
| Water-soluble resin | 500 ppm | |

The water-soluble resin was the same as that used in Surface Treatment Solution 1.

pH 2.5, adjusted using nitric acid and aqueous ammonia

Example 6

Cleaned aluminum DI cans were spray treated in the same manner as described in Example 1 prior to treatment with Surface Treatment Solution 1, then spray treated for 15 seconds with Surface Treatment Solution 6 of the composition below warmed to 35° C. They were then rinsed with tap water, washed with deionized water and hot-air dried as in Example 1. These aluminum DI cans were then evaluated for corrosion resistance and adhesion by the aforementioned methods.

Composition of Surface Treatment Solution 6

| | | |
|---|---|---|
| 75% Phosphoric acid ($H_3PO_4$) | 412 ppm | ($PO_4$: 300 ppm) |
| 20% Fluotitanic acid ($H_2TiF_6$) | 683 ppm | (Ti: 40 ppm) |
| 20% Fluozirconic acid ($H_2ZrF_6$) | 455 ppm | (Zr: 40 ppm) |
| 20% Hydrofluoric acid (HF) | 157 ppm | (F: 80 ppm) |
| Water-soluble resin | 500 ppm | |

The water-soluble resin conformed to Formula (1) above when the average value of n=5, $X^1=X^2=C_2H_5$, and $Y^1=Y^2=CH_2N(CH_2CH_2OH)_2$.

pH 3.0 (adjusted using nitric acid and aqueous ammonia)

Example 7

Cleaned aluminum DI cans were spray treated for 15 seconds with Surface Treatment Solution 7 of the composition below warmed to 35° C., and then rinsed with water, rinsed with deionized water and hot-air dried as in Example 1. These aluminum DI cans were then evaluated for corrosion resistance and adhesion by the aforementioned methods.

Composition of Surface Treatment Solution 7

| | | |
|---|---|---|
| 75% Phosphoric acid ($H_3PO_4$) | 69 ppm | ($PO_4$: 50 ppm) |
| 20% Fluozirconic acid ($H_2ZrF_6$) | 455 ppm | (Zr: 40 ppm) |
| 20% Hydrofluoric acid (HF) | 25 ppm | (F: 55 ppm) |
| 31% Hydrogen peroxide ($H_2O_2$) | 966 ppm | ($H_2O_2$: 300 ppm) |
| Water-soluble resin | 500 ppm | |

The water-soluble resin was the same as that used in Surface Treatment Solution 6.

pH 2.5 (adjusted with nitric acid and aqueous ammonia)

Example 8

Cleaned aluminum DI cans were spray treated for 40 seconds with Surface Treatment Solution 8 of the composition below warmed to 35° C., and then rinsed with water, rinsed with deionized water and hot-air dried as in Example 1. These aluminum DI cans were then evaluated for corrosion resistance and adhesion by the aforementioned methods.

Composition of Surface Treatment Solution 8

| | | |
|---|---|---|
| 75% Phosphoric acid ($H_3PO_4$) | 69 ppm | ($PO_4$: 50 ppm) |
| 20% Fluozirconic acid ($H_2ZrF_6$) | 455 ppm | (Zr: 40 ppm) |
| 20% Hydrofluoric acid (HF) | 25 ppm | (F: 55 ppm) |
| Water-soluble resin | 500 ppm | |

The water-soluble resin was the same as that used in Surface Treatment Solution 6.

pH 2.5 (adjusted with nitric acid and aqueous ammonia)

Example 9

Cleaned aluminum DI cans were spray treated for 15 seconds with Surface Treatment Solution 9 of the composition below warmed to 40° C., and then rinsed with water, rinsed with deionized water and hot-air dried as in Example 1. These aluminum DI cans were then evaluated for corrosion resistance and adhesion by the aforementioned methods.

Composition of Surface Treatment Solution 9

| | | |
|---|---|---|
| 75% Phosphoric acid ($H_3PO_4$) | 69 ppm | ($PO_4$: 50 ppm) |
| 20% Fluotitanic acid ($H_2TiF_6$) | 683 ppm | (Ti: 40 ppm) |
| 20% Hydrofluoric acid (HF) | 25 ppm | (F: 55 ppm) |
| t-Butyl hydroperoxide | 500 ppm | |
| Water-soluble resin | 500 ppm | |

The water-soluble resin was the same as that used in Surface Treatment Solution 6.

pH 2.5 (adjusted with nitric acid and aqueous ammonia)

Example 10

Cleaned aluminum DI cans were spray treated for 40 seconds with Surface Treatment Solution 10 of the composition below warmed to 40° C., and then rinsed with water, rinsed with deionized water and hot-air dried as in Example 1. These aluminum DI cans were then evaluated for corrosion resistance and adhesion by the aforementioned methods.

Composition of Surface Treatment Solution 10

| | | |
|---|---|---|
| 75% Phosphoric acid ($H_3PO_4$) | 69 ppm | ($PO_4$: 50 ppm) |
| 20% Fluotitanic acid ($H_2TiF_6$) | 683 ppm | (Ti: 40 ppm) |
| 20% Hydrofluoric acid (HF) | 25 ppm | (F: 55 ppm) |
| Water-soluble resin | 500 ppm | |

The water-soluble resin was the same as that used in Surface Treatment Solution 6.

pH 2.5 (adjusted with nitric acid and aqueous ammonia)

Example 11

Cleaned aluminum DI cans were treated by immersion for 15 seconds in Surface Treatment Solution 11 of the composition below warmed to 40° C., and then rinsed with water, rinsed with deionized water and hot-air dried as in Example 1. These aluminum DI cans were then evaluated for corrosion resistance and adhesion by the aforementioned methods.

Composition of Surface Treatment Solution 11

| | | |
|---|---|---|
| 75% Phosphoric acid ($H_3PO_4$) | 69 ppm | ($PO_4$: 50 ppm) |
| 20% Fluozirconic acid ($H_2ZrF_6$) | 455 ppm | (Zr: 40 ppm) |
| 20% Hydrofluoric acid (HF) | 25 ppm | (F: 55 ppm) |
| 31% Hydrogen peroxide ($H_2O_2$) | 966 ppm | ($H_2O_2$: 300 ppm) |
| Water-soluble resin | 500 ppm | |

The water-soluble resin was the same as that used in Surface Treatment Solution 6.

pH 2.5 (adjusted with nitric acid and aqueous ammonia)

Example 12

Cleaned aluminum DI cans were treated by immersion for 50 seconds in Surface Treatment Solution 12 of the composition below warmed to 40° C., and then rinsed with water, rinsed with deionized water and hot-air dried as in Example 1. These aluminum DI cans were then evaluated for corrosion resistance and adhesion by the aforementioned methods.

Composition of Surface Treatment Solution 12

| | | |
|---|---|---|
| 75% Phosphoric acid ($H_3PO_4$) | 69 ppm | ($PO_4$: 50 ppm |
| 20% Fluozirconic acid ($H_2ZrF_6$) | 455 ppm | (Zr: 40 ppm) |
| 20% Hydrofluoric acid (HF) | 25 ppm | (F: 55 ppm) |
| Water-soluble resin | 500 ppm | |

The water-soluble resin was the same as that used in Surface Treatment Solution 6.

pH 2.5 (adjusted with nitric acid and aqueous ammonia)

Example 13

Cleaned aluminum DI cans were treated by immersion for 15 seconds in Surface Treatment Solution 13 of the composition below warmed to 40° C., and then rinsed with water, rinsed with deionized water and hot-air dried as in Example 1. These aluminum DI cans were then evaluated for corrosion resistance and adhesion by the aforementioned methods.

Composition of Surface Treatment Solution 13

| | | |
|---|---|---|
| 75% Phosphoric acid ($H_3PO_4$) | 69 ppm | ($PO_4$: 50 ppm) |
| 20% Fluozirconic acid ($H_2ZrF_6$) | 455 ppm | (Zr: 40 ppm) |
| 20% Hydrofluoric acid (HF) | 25 ppm | (F: 55 ppm) |
| 31% Hydrogen peroxide ($H_2O_2$) | 644 ppm | ($H_2O_2$: 200 ppm) |
| Water-soluble resin | 500 ppm | |

The water-soluble resin was the same as that used in Surface Treatment Solution 6.

pH 2.5 (adjusted with nitric acid and aqueous ammonia)

Example 14

Cleaned aluminum DI cans were treated by immersion for 50 seconds in Surface Treatment Solution 14 of the composition below warmed to 40° C., and then rinsed with water, rinsed with deionized water and hot-air dried as in Example 1. These aluminum DI cans were then evaluated for corrosion resistance and adhesion by the aforementioned methods.

Composition of Surface Treatment Solution 14

| | | |
|---|---|---|
| 75% Phosphoric acid ($H_3PO_4$) | 69 ppm | ($PO_4$: 50 ppm) |
| 20% Fluozirconic acid ($H_2ZrF_6$) | 455 ppm | (Zr: 40 ppm) |
| 20% Hydrofluoric acid (HF) | 25 ppm | (F: 55 ppm) |
| Water-soluble resin | 500 ppm | |

The water-soluble resin was the same as that used in Surface Treatment Solution 6.

pH 2.5 (adjusted with nitric acid and aqueous ammonia)

Comparison Example 1

Cleaned DI aluminum cans were spray treated for 25 seconds with ALODINE® 404 zirconium phosphate surface treatment solution for aluminum DI cans (commercially supplied by Nihon Parkerizing) warmed to 35° C., and then rinsed with tap water, washed with deionized water and hot-air dried as in Example 1; these aluminum DI cans were then evaluated for corrosion resistance and adhesion by the aforementioned methods.

Comparison Example 2

Cleaned DI aluminum cans were spray treated for 25 seconds with ALODINE® 404 zirconium phosphate surface treatment solution for aluminum DI cans (commercially supplied by Nihon Parkerizing) warmed to 35° C., and then treated by spraying for 2 seconds in Surface Treatment Solution 15 of the composition below warmed to 35° C., and then rinsed with water, rinsed with deionized water and hot-air dried as in Example 1, and these aluminum DI cans were then evaluated for corrosion resistance and adhesion by the aforementioned methods.

Composition of Surface Treatment Solution 15

| | | |
|---|---|---|
| 75% Phosphoric acid ($H_3PO_4$) | 69 ppm | ($PO_4$: 50 ppm) |
| 20% Fluozirconic acid ($H_2ZrF_6$) | 455 ppm | (Zr: 40 ppm) |
| 20% Hydrofluoric acid (HF) | 25 ppm | (F: 55 ppm) |
| Water-soluble resin | 500 ppm | |

The water-soluble resin was the same as that used in Surface Treatment Solution 6.

pH 2.5 (adjusted with nitric acid and aqueous ammonia)

Comparison Example 3

Cleaned aluminum DI cans were spray treated in the same manner as described in Comparison Example 2 prior to treatment with Surface Treatment Solution 15, then treated by spraying for 120 seconds in Surface Treatment Solution 16 of the composition below warmed to 35° C., and then rinsed with water, rinsed with deionized water and hot-air dried as in Example 1, and these aluminum DI cans were then evaluated for corrosion resistance and adhesion by the aforementioned methods.

Composition of Surface Treatment Solution 16

| | | |
|---|---|---|
| 75% Phosphoric acid ($H_3PO_4$) | 138 ppm | ($PO_4$: 100 ppm) |
| 20% Fluozirconic acid ($H_2ZrF_6$) | 500 ppm | (Zr: 44 ppm) |
| 20% Hydrofluoric acid (HF) | 210 ppm | (F: 40 ppm) |
| pH 3.0 (adjusted with nitric acid and aqueous ammonia) | | |

Comparison Example 4

Cleaned aluminum DI cans were spray treated for 20 seconds in Surface Treatment Solution 17 of the composition below warmed to 35° C., and then rinsed with water, rinsed with deionized water and hot-air dried as in Example 1, and the resulting aluminum DI cans were evaluated for corrosion resistance and adhesion by the aforementioned methods.

Composition of Surface Treatment Solution 17

| | | |
|---|---|---|
| 75% Phosphoric acid ($H_3PO_4$) | 138 ppm | ($PO_4$: 100 ppm) |
| 20% Fluozirconic acid ($H_2ZrF_6$) | 500 ppm | (Zr: 44 ppm) |
| 20% Hydrofluoric acid (HF) | 236 ppm | (F: 60 ppm) |
| Water-soluble resin | 500 ppm | |

The water-soluble resin was the same as that used in Surface Treatment Solution 6.

pH 0.8 (adjusted with nitric acid)

Comparison Example 5

Cleaned aluminum DI cans were spray treated for 1 second with the aforementioned Surface Treatment Solution 8 warmed to 35° C., and then rinsed with water, rinsed with deionized water and hot-air dried as in Example 1. The resulting aluminum DI cans were evaluated for corrosion resistance and adhesion by the aforementioned methods.

Comparison Example 6

Cleaned aluminum DI cans were spray treated in the same manner as described in Comparison Example 2 prior to treatment with Surface Treatment Solution 15, and then surface treated as disclosed in Japanese Unexamined Patent Document S64-85292. The resulting aluminum DI cans were then evaluated for corrosion resistance, adhesion and mobility by the aforementioned methods.

Comparison Example 7

Cleaned aluminum DI cans were spray treated in the same manner as described in Comparison Example 2 prior to treatment with Surface Treatment Solution 15, and then surface treated as disclosed in Japanese Unexamined Patent Document H04-66671. The resulting aluminum DI cans were then evaluated for corrosion resistance, adhesion and mobility by the aforementioned methods.

The evaluation results for Examples 1 to 14 and Comparative Examples 1 to 7 are reported in Table 1.

In Comparison Example 2, the aluminum-containing metal was brought into contact with a conventional zirconium phosphate type surface treatment solution and then, without rinsing in water, the surface film formed was brought into contact with a surface treatment solution of the present invention for 1 second; however, because the duration of contact between the aluminum-containing metal and the surface treatment solution of the present invention was outside the limits thereof, outstanding whitening resistance and mobility were not obtained.

In Comparison Example 3, the aluminum-containing metal was brought into contact for 25 seconds with a conventional zirconium phosphate type surface treatment solution and then, without rinsing in water, the surface film formed was brought into contact for 20 seconds with Surface Treatment Solution 16. Surface Treatment Solution 16 did not include a water-soluble resin of the present invention, and consequently outstanding whitening resistance was not obtained.

TABLE 1

Results of the Evaluations

| | Corrosion Test Results | | | Paint Adhesion Test Results, Primary and | $mg/M^2$ of Metal(s) in |
|---|---|---|---|---|---|
| | Darkening | Whitening | Mobility | Secondary | Coating Formed |
| Example Number | | | | | |
| 1 | + | + | + | no peeling | Zr: 14 |
| 2 | + | + | + | no peeling | Zr: 12 |
| 3 | + | + | + | no peeling | Zr: 12; Ti: 3 |
| 4 | + | + | + | no peeling | Zr: 14 |
| 5 | + | + | + | no peeling | Zr: 14 |
| 6 | + | + | + | no peeling | Zr: 13; Ti: 4 |
| 7 | + | + | + | no peeling | Zr: 9 |
| 8 | + | + | + | no peeling | Zr: 10 |
| 9 | + | + | + | no peeling | Ti: 10 |
| 10 | + | + | + | no peeling | Ti: 9 |
| 11 | + | + | + | no peeling | Zr: 9 |
| 12 | + | + | + | no peeling | Zr: 10 |
| 13 | + | + | + | no peeling | Zr: 8 |
| 14 | + | + | + | no peeling | Zr: 7 |
| Comparison | | | | | |
| 1 | + | x | xx | no peeling | Zr: 14 |
| 2 | + | x | xx | no peeling | Zr: 13 |
| 3 | + | x | xx | some peeling | Zr: 22 |
| 4 | + | xx | xx | no peeling | Zr: 15 |
| 5 | xx | xx | xx | no peeling | Zr: 2 |
| 6 | + | x | + | no peeling | Zr: 12 |
| 7 | + | x | + | some peeling | Zr: 12 |

It is clear from the results of Table 1 that in Examples 1 to 14, in each of which a surface treatment solution and method of the present invention was used, the corrosion resistance, mobility and adhesion to paint of the resulting surfaces were outstanding. On the other hand, the surface coating films of Comparison Examples 1 to 4 in which a surface treatment solution and method for surface treatment outside the limits of the present invention were used were inferior in at least one of darkening, whitening, mobility, or adhesion to paint:

Comparison Example 1 did not contain the water-soluble resin which is required in a surface treatment solution of the present invention, and consequently ade quate whitening resistance and mobility were not obtained.

In addition, the quantity of zirconium adhered to the aluminum-containing metal was excessive, and hence outstanding adhesion to paint was not obtained.

In Comparison Example 4, the pH of a surface treatment otherwise according to the present invention was lowered to 0.8, with the result that the etching effecton the surface of the aluminum-containing metal became excessive, it became difficult to form a surface coating film and outstanding resistance to darkening and whitening were not obtained.

In Comparison Example 5, the duration of contact between the aluminum-containing metal and the surface treatment solution of the present invention was shortened to 1 second, so that adequate surface film formation was not possible and there was no noticeable improvement in blackening resistance, whitening resistance or mobility.

In Comparison Example 6, with the surface treatment disclosed in Japanese Unexamined Patent Document S64-85292 only mobility was improved; there was no noticeable improvement in whitening resistance.

In Comparison Example 7, the surface treatment disclosed in Japanese Unexamined Patent Document H04-66671 did not give outstanding paint adhesion.

Benefits of the Invention

It is clear from the explanation above that with a surface treatment solution and method for surface treatment of the present invention it is possible to form on the unpainted surface of aluminum-containing metallic material a coating film which has outstanding corrosion resistance, mobility and adhesion to paint.

In addition, by treating the surface of aluminum DI cans with a surface treatment solution of the present invention it is possible to confer outstanding corrosion resistance and adhesion to paint on the surface of the aluminum cans before painting and printing, and it also becomes possible to make conveying more smooth.

Therefore, surface solutions for surface treatment of metallic materials containing aluminum and the method of surface treatment of the present invention are both extremely practically useful.

The invention claimed is:

1. An aqueous liquid composition for treating the surface of aluminiferous metals, either as such or after dilution with additional water, said composition comprising water and, in parts by weight:

(A) from 1 to 100 parts of dissolved phosphate ions;

(B) an amount of material selected from the group consisting of dissolved zirconium, titanium, or both zirconium and titanium containing compounds that is stoichiometrically equivalent to from 1 to 50 parts of zirconium and/or titanium atoms;

(C) an amount of material selected from the group consisting of dissolved fluorine-containing anions that is stoichiometrically equivalent to from 1 to 100 parts of fluorine atoms; and (D) from 1 to 200 parts of dissolved polymer conforming to the following general formula (I):

(I)

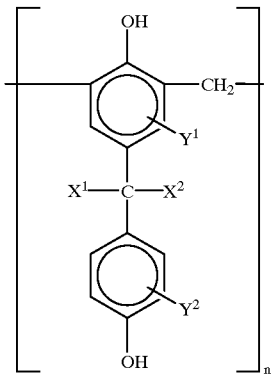

in which each of $X^1$ and $X^2$ independently of each other and independently from one unit of the polymer, said unit being defined as a moiety conforming to a modification of formula (I) above with the brackets and the subscript n omitted, to another unit of the polymer represents a hydrogen atom, a $C_1$ to $C_5$ alkyl group, or a $C_1$ to $C_5$ hydroxyalkyl group; each of $Y^1$ and $Y^2$ independently of one another and independently for each unit of the polymer represents a hydrogen atom or a moiety "Z" which conforms to one of the following formulas (II) and (III):

(II)

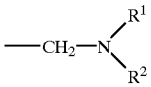

(III)

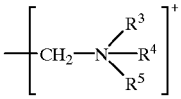

wherein each of $R^1$, $R^2$, $R^3$, $R^4$, and $R^5$ in formulas (II) and (III) independently represents a $C_1$ to $C_{10}$ alkyl group or a $C_1$ to $C_{10}$ hydroxyalkyl group; one moiety Z in the polymer molecule may be identical to or may differ from any other moiety Z in the polymer molecule, so long as each conforms to one of formulas (II) and (III); the average value for the number of Z moieties substituted on each aromatic ring in the polymer molecule is from 0.2 to 1.0; n is a positive integer; and the average value of n over all of component (D) is from 2 to 50.

2. A composition according to claim 1, additionally comprising from 1 to 100 parts by weight of an oxidizing agent component (E) that is selected from the group consisting of hydrogen peroxide and organic peroxy compounds.

3. A composition according to claim 2, wherein components (A) through (D) are present in amounts having a ratio to one another of 2 to 40 parts of component (A): 2 to 8 parts of stoichiometric equivalent of zirconium and titanium in total of component (B): 3 to 60 parts of stoichiometric equivalent of fluorine atoms of component (C): 1 to 200 parts of water-soluble polymer of component (D).

4. A composition according to claim 1, wherein components (A) through (D) are present in amounts having a ratio to one another of 2 to 40 parts of component (A): 2 to 8 parts of stoichiometric equivalent of zirconium and titanium in total of component (B): 3 to 60 parts of stoichiometric equivalent of fluorine atoms of component (C): 1 to 200 parts of water-soluble polymer of component (D).

5. A composition according to claim 3 having: a pH value from 1.0 to 5.0, dissolved phosphate ions present in a concentration from 0.01 to 1.0 g/L, component (B) present in an amount corresponding stoichiometrically to from 0.01 to 0.50 g/L total of zirconium and titanium, component (C) present in an amount corresponding stoichiometrically to from 0.01 to 2.0 g/L of atomic fluorine, component (D) present in a concentration from 0.01 to 2.0 g/L, and oxidizing agent present in a concentration from 0.01 to 1.0 g/L.

6. A process for treating an aluminiferous metal surface in order to form on said surface a corrosion protective, paint adherent coating, said process comprising steps of:

(I) bringing the metal surface being treated into contact with an aqueous liquid coat-forming composition according to claim 5, so as to convert the metal surface contacted to a coated metal surface;

(II) separating the coated metal surface formed in step (I) from the aqueous liquid coat-forming composition with which it was contacted in step (I) and thereafter rinsing the coated metal surface with water to produce a rinsed coated metal surface; and (III) heating the rinsed coated metal surface sufficiently to dry said surface and form a dry coated metal surface.

7. A process according to claim 6, wherein the dry coated metal surface has an amount of total of titanium and zirconium on its surface that is greater by from 6 to 20 $mg/m^2$ than was present on the surface of the metal substrate before beginning step (I).

8. A process according to claim 7, wherein contact in step (I) is maintained for a time from 5 to 20 seconds and the temperature of the aqueous liquid coat-forming composition during step (I) is from 25 to 60° C.

9. A process according to claim 6, wherein contact in step (I) is maintained for a time from 5 to 20 seconds and the temperature of the aqueous liquid coat-forming composition during step (I) is from 25 to 60° C.

10. A composition according to claim 4 having: a pH value from 1.0 to 5.0, dissolved phosphate ions present in a concentration from 0.01 to 1.0 g/L, component (B) present in an amount corresponding stoichiometrically to from 0.01 to 0.50 g/L total of zirconium and titanium, component (C) present in an amount corresponding stoichiometrically to from 0.01 to 2.0 g/L of atomic fluorine, component (D) present in a concentration from 0.01 to 2.0 g/L, and oxidizing agent either absent or present in a concentration from 0.01 to 1.0 g/L.

11. A process for treating an aluminiferous metal surface in order to form on said surface a corrosion protective, paint adherent coating, said process comprising steps of:

(I) bringing the metal surface being treated into contact with an aqueous liquid coat-forming composition according to claims 10, so as to convert the metal surface contacted to a coated metal surface;

(II) separating the coated metal surface formed in step (I) from the aqueous liquid coat-forming composition with which it was contacted in step (I) and thereafter rinsing the coated metal surface with water to produce a rinsed coated metal surface; and (III) heating the rinsed coated metal surface sufficiently to dry said surface and form a dry coated metal surface.

12. A process according to claim 11, wherein the dry coated metal surface has an amount of total of titanium and zirconium on its surface that is greater by from 6 to 20 $mg/m^2$ than was present on the surface of the metal substrate before beginning step (I).

13. A process according to claim 12, wherein contact in step (I) is maintained for a time from 2 to 100 seconds and the temperature of the aqueous liquid coat-forming composition during step (I) is from 25 to 60° C.

14. A process according to claim 11, wherein contact in step (I) is maintained for a time from 2 to 100 seconds and the temperature of the aqueous liquid coat-forming composition during step (I) is from 25 to 60° C.

15. A composition according to claim 1 having: a pH value from 1.0 to 5.0, dissolved phosphate ions present in a concentration from 0.01 to 1.0 g/L, component (B) present in an amount corresponding stoichiometrically to from 0.01 to 0.50 g/L total of zirconium and titanium, component (C) present in an amount corresponding stoichiometrically to from 0.01 to 2.0 g/L of atomic fluorine, component (D) present in a concentration from 0.01 to 2.0 g/L, and oxidizing agent either absent or present in a concentration from 0.01 to 1.0 g/L.

16. A process for treating an aluminiferous metal surface in order to form on said surface a corrosion protective, paint adherent coating, said process comprising steps of:

(I) bringing the metal surface being treated into contact with an aqueous liquid coat-forming composition according to claim 15, so as to convert the metal surface contacted to a coated metal surface;

(II) separating the coated metal surface formed in step (I) from the aqueous liquid coat-forming composition with which it was contacted in step (I) and thereafter rinsing the coated metal surface with water to produce a rinsed coated metal surface; and (III) heating the rinsed coated metal surface sufficiently to dry said surface and form a dry coated metal surface.

17. A process according to claim 16, wherein the dry coated metal surface has an amount of total of titanium and zirconium on its surface that is greater by from 6 to 20 $mg/m^2$ than was present on the surface of the metal substrate before beginning step (I).

18. A process according to claim 17, wherein contact in step (I) is maintained for a time from 3 to 50 seconds and the temperature of the aqueous liquid coat-forming composition during step (I) is from 25 to 60° C.

19. A process according to claim 16, wherein contact in step (I) is maintained for a time from 2 to 100 seconds and the temperature of the aqueous liquid coat-forming composition during step (I) is from 25 to 60° C.

20. A process for treating an aluminiferous metal surface in order to form on said surface a corrosion protective, paint adherent coating, said process comprising steps of:

(I) bringing the metal surface being treated into contact with an aqueous liquid coat-forming composition according to claim 1, so as to convert the metal surface contacted to a coated metal surface;

(II) separating the coated metal surface formed in step (I) from the aqueous liquid coat-forming composition with which it was contacted in step (I) and thereafter rinsing the coated metal surface with water to produce a rinsed coated metal surface; and (III) heating the rinsed coated metal surface sufficiently to dry said surface and form a dry coated metal surface.

* * * * *

UNITED STATES PATENT AND TRADEMARK OFFICE

CERTIFICATE OF CORRECTION

PATENT NO. : 6,059,896
DATED : May 9, 2000
INVENTOR(S) : Ehara et al.

It is certified that error appears in the above-identified patent and that said Letters Patent is hereby corrected as shown below:

Title page,
Item [57], ABSTRACT,
Line 10, delete "$X_2$", and insert -- $X^2$ --.
Line 12, after "that", insert -- conforms --.

Signed and Sealed this

Twenty-first Day of February, 2006

JON W. DUDAS
*Director of the United States Patent and Trademark Office*